US006732835B1

(12) United States Patent
Souto et al.

(10) Patent No.: US 6,732,835 B1
(45) Date of Patent: May 11, 2004

(54) ROOFING STAGE FOR PITCHED ROOFS

(76) Inventors: João Souto, 10 Groom St., Apt. 1, Boston, MA (US) 02125; Nuno Daniel Souto, 10 Groom St., Apt. 1, Boston, MA (US) 02125

( * ) Notice: Subject to any disclaimer, the term of this patent is extended or adjusted under 35 U.S.C. 154(b) by 0 days.

(21) Appl. No.: 10/326,932

(22) Filed: Dec. 23, 2002

(51) Int. Cl.[7] ..... E04G 1/36; E04G 3/00; E04G 3/08

(52) U.S. Cl. ..... 182/45; 182/82; 248/237; 52/749.12

(58) Field of Search ..... 182/45, 82, 150; 248/237; 52/749.12

(56) References Cited

U.S. PATENT DOCUMENTS 3,842,934 A * 10/1974 Bartlett ..... 182/37
5,050,705 A * 9/1991 Natwick ..... 182/45
5,113,971 A 5/1992 Violet
5,197,257 A * 3/1993 Nietling ..... 52/749.12
5,205,103 A * 4/1993 Burton ..... 52/749.12
5,513,826 A * 5/1996 Lebaron ..... 248/237
5,624,006 A 4/1997 Richardson
5,862,880 A 1/1999 Nelson
5,875,867 A 3/1999 Beard
5,908,083 A * 6/1999 Hamilton ..... 182/45
6,131,698 A 10/2000 Reyland
6,167,987 B1 1/2001 Jensen

* cited by examiner

*Primary Examiner*—Hugh B. Thompson, II

(57) ABSTRACT

A roofing stage for pitched roofs includes first and second elongated tracks disposed generally parallel to one another. A base bracket attaches a lower end of each track to roof beams. Padded feet extend from a bottom surface of the tracks for contact with the roof. Hooks extend from upper ends of the first and second brackets for attachment to an apex of the roof. A carriage bracket is slidably attached to each track and has a foot support extending therefrom. A platform bracket is slidably attached to each of the first and second tracks above the carriage brackets for supporting a platform therebetween. The movable brackets enable the roofer to property position himself and necessary tools and supplies.

2 Claims, 2 Drawing Sheets

ROOFING STAGE FOR PITCHED ROOFS

BACKGROUND OF THE INVENTION

The present invention generally relates to the process of shingling roofs. More particularly, the present invention relates to a roofing stage assembly for pitched roofs to facilitate the shingling of such roofs.

To protect a house or structure from the adverse elements, shingles are often applied to a roof. This entails covering the rafters/roof beams, such as with plywood sheets or the like. Tar paper is then often tacked onto the plywood sheets. Shingles or the like are then tacked onto the roof. Typically, the shingles are first applied at the base and overlap one another until reaching the apex portion of the roof so that water can cascade over the shingles and off of the roof, and not enter the structure.

These materials must be brought on to the roof surface, and workers properly and safely positioned in location on the roof to nail or glue these materials in place. In the past, strips of wood would be affixed to the plywood sheets to provide foot supports for the roofers while tacking down the tar paper and shingles. These would be removed as the section of the roof were shingled. Alternatively, scaffolding was used to elevate the roofers to the appropriate height of the roof, particularly on very steep pitched roofs.

However, there is a continuing need for a roofing stage which is removably attachable to a roof and which facilitates placement of the roofer and supplies on the pitched roof. The present invention fulfills these needs and provides other related advantages.

SUMMARY OF THE INVENTION

The present invention resides in a roofing stage for pitched roofs. It comprises first and second elongated tracks which are disposed generally parallel to one another. Base brackets of each track attach the lower end of each track to roof beams. Feet extend from a bottom surface of the first and second tracks and contact the roof. Typically, these feet are padded.

A carriage bracket is slidably attached to each of the first and second tracks. The carriage bracket includes a foot support extending therefrom. Above the carriage brackets are platform brackets which are also slidably attached to each track. A platform extends between the platform brackets for holding tools and materials and the like. Means for attaching the upper ends of the tracks to an upper edge of the roof are provided, typically in the form of hooks which extend from upper ends of the tracks. Preferably, the carriage and platform brackets are automatically moved along the tracks by use of a motor or the like.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
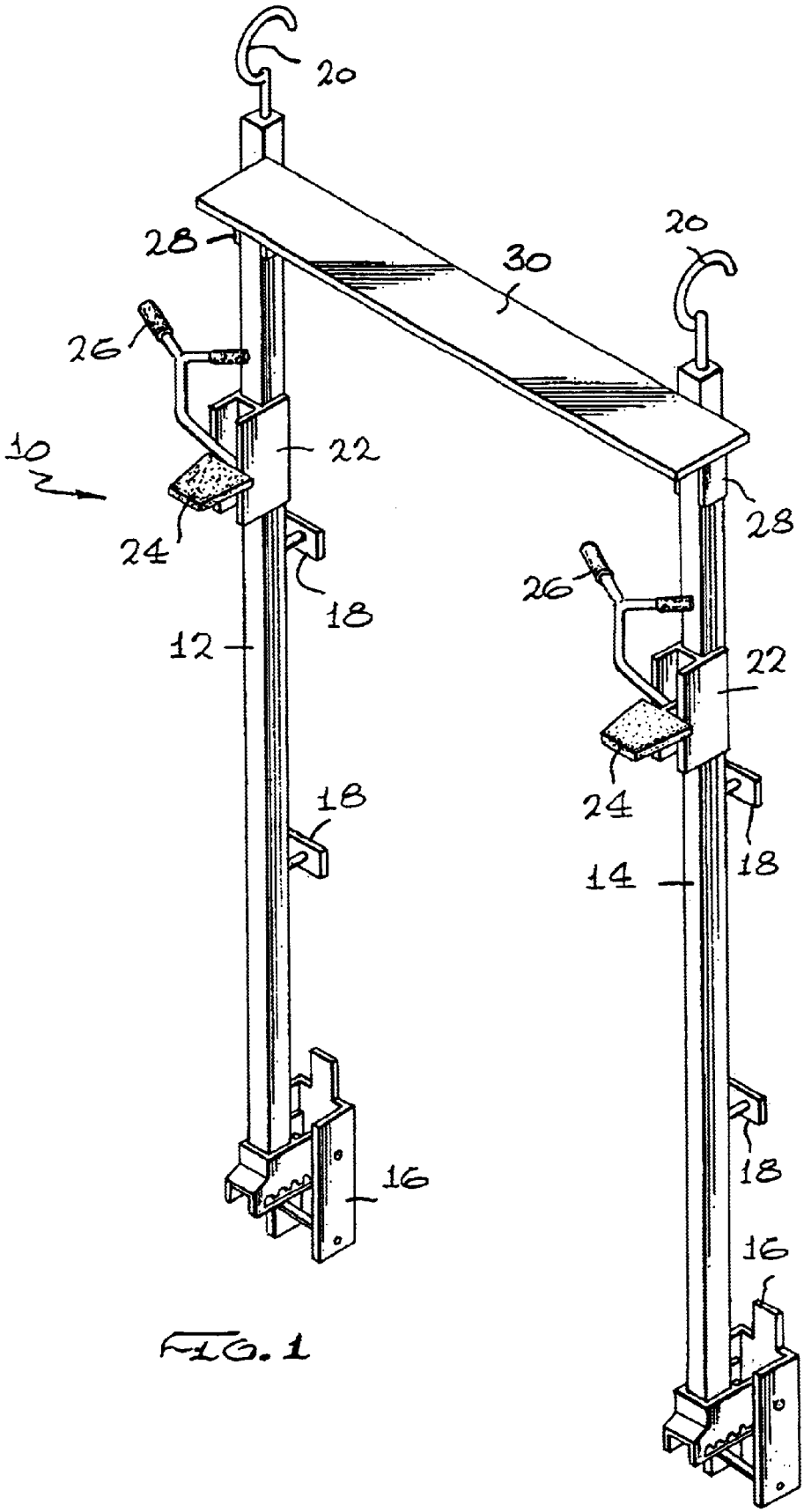
FIG. 1 is a front perspective view of a roofing stage embodying the present invention.

As shown in the drawings for purposes of illustration, the present invention resides in a roofing stage, generally referred to by the reference number 10, for shingling pitched roofs. The present invention is intended to solve the problem of using a plurality of planks going upward to shingle or otherwise repair pitched roofs, as well as completing the job much faster.

Figure 2:
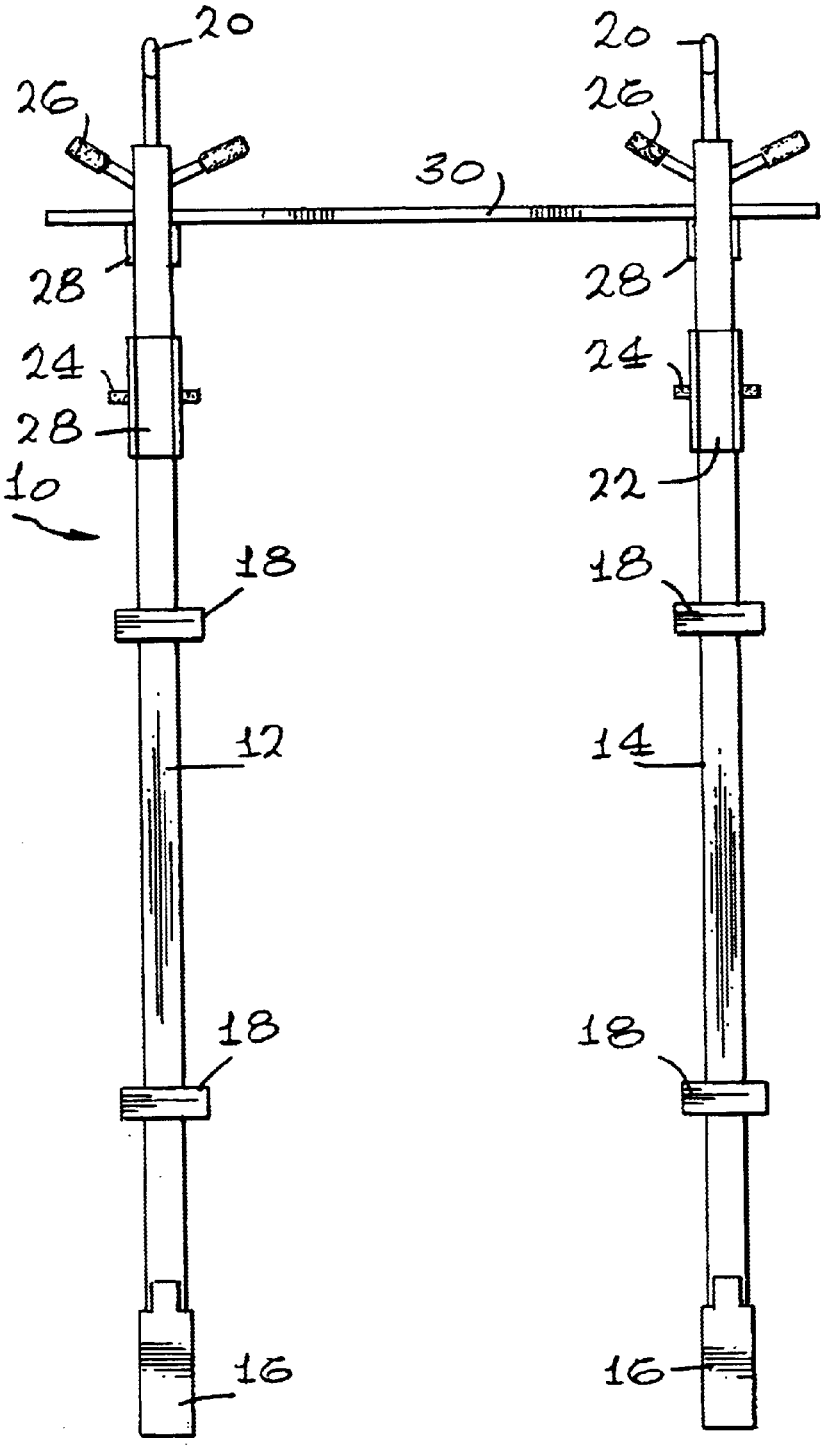
FIG. 2 is a rear elevational view of the roofing stage of FIG. 1.
Figure 3:
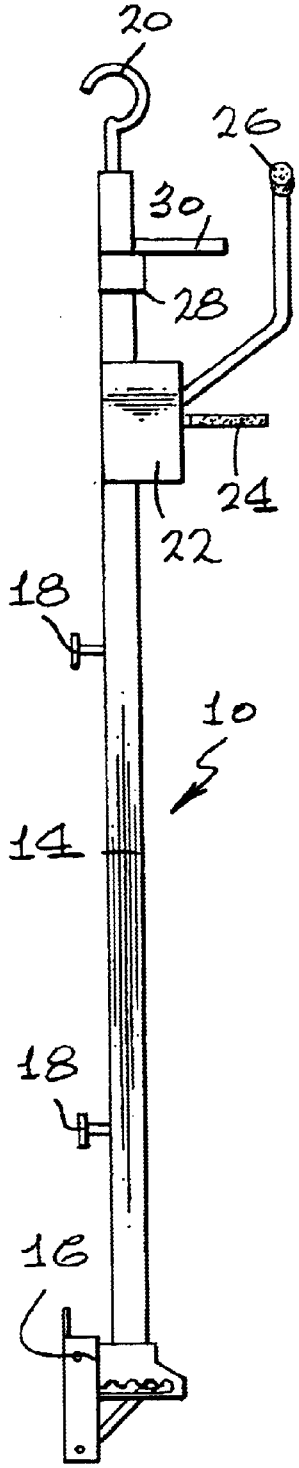
FIG. 3 is a side elevational view of the roofing stage of the present invention.

With reference to FIGS. 1–3, the stage 10 is comprised of first and second tracks 12 and 14 spaced from one another and generally disposed parallel to one another. The tracks 12 and 14, as illustrated, comprise poles. However, the poles 12 and 14 may include tracks therein, or the tracks may be comprised of other configurations. The tracks 12 and 14 are elongated, preferably of a length approximating the height or width of the roof in question. A base bracket 16 is attached to the end of each track 12 and 14. The base bracket 16 is attachable to a beam of the roof (not shown). Feet 18 extend from a bottom surface of each track or pole 12 and 14 so as to be in contact with the roof, and create a small space between the tracks 12 and 14 and the roof itself. Preferably, the feet 18 are padded to create a frictional gripping surface to prevent movement of the tracks 12 and 14, as well as preventing damage to the roof surface. As shown in the drawings, typically, several feet 18 are used on each track 12 and 14. These feet 18 are preferably moveable to different positions along the tracks 12 and 14, in order to meet the needs of the roofer.

Hooks 20 extend from an upper end of each track 12 and 14. The hooks 20 are intended to attach the stage 10, and particularly each track 12 and 14 to a ridge or apex of the roof. Those skilled in the art will appreciate other means for attaching the stage 10 to the apex of the roof.

A carriage bracket 22 is attached to each track 12 and 14. The carriage bracket 22 is slidably attached to the tracks 12 and 14 so as to be movable along the lengths thereof. A foot platform support 24 extends from each bracket 22 to provide support for the roofer. Other supportive members 26 may extend from the carriage bracket 22 as necessary. Such support members 26 can support the needs of the roofer, or be used to hang tools and the like.

Platform brackets 28 are slidably attached to the tracks 12 and 14, typically above the carriage brackets 22. These brackets 28 serve to securely support a platform or plank 30. Such platform 30 can be used to support the roofer, tools, supplies, etc.

It will be appreciated by those skilled in the art that the sliding feature of the carriage and platform brackets 22 and 28 enable a worker, and his tools and materials to be gradually moved from the base of the roof to the apex of the roof during roof construction and repair. In a particularly preferred embodiment, a motor is operably linked to the brackets 22 and 28 so that the worker can position such brackets 22 and 28 with the use of a control device, such as an electronically linked toggle switch or the like. Such motorized linkages for moving brackets along tracks 12 and 14 are known in the art and can be implemented into the present invention with undue experimentation.

Although several embodiments have been described in detail for purposes of illustration, various modifications may be made without departing from the scope and spirit of the invention. Accordingly, the invention is not to be limited, except as by the appended claims.

What is claimed is:

1. A roofing stage for pitched roofs, comprising:

a first elongated track;

a second elongated track disposed generally parallel to the first track;

a base bracket attached to a lower end of each track for attaching the tracks to roof beams;

padded feet extending from a bottom surface of the first and second tracks for contact with the roof;

a carriage bracket slidably, attached to each of the first and second tracks, and having a foot support extending laterally therefrom;

a platform bracket slidably attached to each of the first and second tracks above the carriage brackets;

a platform extending between the platform brackets; and hooks extending from upper ends of the first and second tracks.

2. The roofing stage of claim 1, including means operably connected to the carriage and platform brackets for controllably moving the carriage and platform brackets along the length of the first and second tracks.

* * * * *